US006595283B1

(12) United States Patent
Turley et al.

(10) Patent No.: US 6,595,283 B1
(45) Date of Patent: Jul. 22, 2003

(54) EXTRUSION RESISTANT INFLATABLE TOOL

(75) Inventors: Rocky A. Turley, Houston, TX (US); Yusheng Yuan, Houston, TX (US)

(73) Assignee: Baker Hughes Incorporated, Houston, TX (US)

( * ) Notice: Subject to any disclaimer, the term of this patent is extended or adjusted under 35 U.S.C. 154(b) by 0 days.

(21) Appl. No.: 09/619,463

(22) Filed: Jul. 19, 2000

Related U.S. Application Data

(60) Provisional application No. 60/144,508, filed on Jul. 19, 1999.

(51) Int. Cl.[7] ..... E21B 33/12; E21B 33/127

(52) U.S. Cl. ..... 166/195; 277/331; 277/334

(58) Field of Search ..... 166/189, 175, 166/195; 277/331, 334

(56) References Cited

U.S. PATENT DOCUMENTS

| | | | | | |
|---|---|---|---|---|---|
| 3,581,816 | A | | 6/1971 | Malone | |
| 3,837,947 | A | * | 9/1974 | Malone | 156/69 |
| 4,349,204 | A | | 9/1982 | Malone | |
| 4,406,461 | A | * | 9/1983 | McGill | 277/334 |
| 4,424,861 | A | | 1/1984 | Carter, Jr. et al. | |
| 4,611,658 | A | | 9/1986 | Salerni et al. | |
| 4,614,346 | A | * | 9/1986 | Ito | 277/334 |
| 4,632,406 | A | | 12/1986 | Akkerman | |
| 4,745,972 | A | | 5/1988 | Bell et al. | |
| 4,832,120 | A | * | 5/1989 | Coronado | 166/187 |
| 4,852,394 | A | | 8/1989 | Goans | |
| 4,886,117 | A | | 12/1989 | Patel | |
| 4,892,144 | A | | 1/1990 | Coone | |
| 4,951,747 | A | * | 8/1990 | Coronado | 166/187 |
| 4,979,570 | A | | 12/1990 | Mody | |
| 5,327,962 | A | | 7/1994 | Head | |
| 5,337,823 | A | | 8/1994 | Nobileau | |
| 5,353,871 | A | * | 10/1994 | Esilinger et al. | 166/187 |
| 5,404,947 | A | * | 4/1995 | Sorem et al. | 166/187 |
| 5,507,341 | A | * | 4/1996 | Eslinger et al. | 166/187 |
| 5,579,839 | A | * | 12/1996 | Culpepper | 166/118 |
| 5,695,008 | A | * | 12/1997 | Bertet et al. | 166/187 |
| 5,813,459 | A | * | 9/1998 | Carisella | 166/187 |
| 6,009,951 | A | | 1/2000 | Coronado et al. | |
| 6,158,506 | A | * | 12/2000 | Carisella | 166/187 |

* cited by examiner

*Primary Examiner*—David Bagnell
*Assistant Examiner*—Jennifer H Gay
(74) *Attorney, Agent, or Firm*—Cantor Colburn LLP

(57) ABSTRACT

Extrusion resistant inflatable tool having a biaxially oriented woven material disposed about at least one elastomeric element of the inflatable tool and radially inwardly of a rib structure of the inflatable tool. The woven material prevents extrusion of the elastomeric element between individual ribs of the ribs structure during the inflation of the tool.

12 Claims, 2 Drawing Sheets

EXTRUSION RESISTANT INFLATABLE TOOL

CROSS REFERENCE TO RELATED APPLICATIONS

This application claims the benefit of an earlier filing date from U.S. Provisional Application Ser. No. 60/144,508 filing date Jul. 19, 1999.

BACKGROUND OF THE INVENTION

1. Field of the Invention

The invention relates to downhole oil field tools. More particularly, the invention relates to performance enhancing devices for inflatable elements.

2. Prior Art

Inflatable elements such as packers have been known and used in the hydrocarbon production industry for a substantial period of time. During this time they have been reliable and favored by oil well operators in many sealing operations. Prior art inflatable elements have however had difficulty with setting in noncylindrical boreholes. Noncylindrical boreholes include oval boreholes, unconsolidated boreholes, windows, etc. The problems of the prior art inflatable elements in noncylindrical boreholes has been that the rubber of the inflatable boot is extruded through the ribs of the element. This can cause severe damage to the rubber of the boot and to the ribs of the element and may result in failure of the device. Thus, the art is in need of a means to avoid extrusion of the rubber boot of the inflatable element through the rib portion of the inflatable element during inflation of a tool in a noncylindrical environment.

SUMMARY OF THE INVENTION

The above-identified drawbacks of the prior art are overcome or alleviated by the extrusion resistant inflatable tool of the invention.

In the invention, a biaxially woven sleeve is interposed between the boot/inner-tube and the ribs of a tool having otherwise conventional components. The sleeve is preferably constructed of carbon fiber, aramid fiber, fiber glass or suitable alternative fiber which provides a bridge between the ribs of the inflatable tool as the element expands into the noncylindrical environment. The existence of the biaxially woven sleeve in an annular area outside the boot and inside the ribs of the element prevents the boot from being extruded through the ribs when they open excessively during expansion into a noncylindrical borehole environment. The sleeve further prevents excessive bending of the ribs which would otherwise create difficulties in removing the tool from the downhole environment.

BRIEF DESCRIPTION OF THE DRAWINGS

Referring now to the drawings wherein like elements are numbered alike in the several FIGURES.

DETAILED DESCRIPTION OF THE INVENTION

Figure 1:
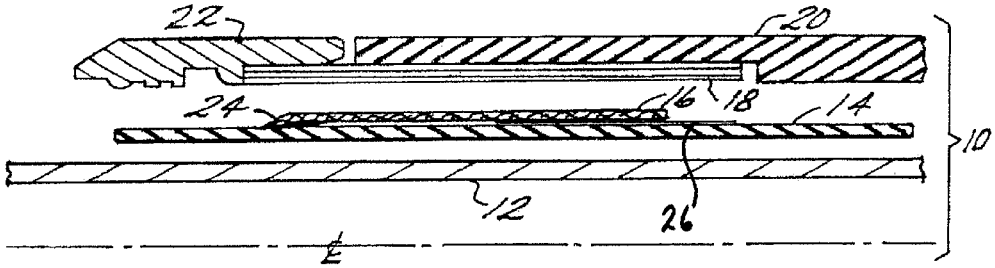
FIG. 1 is a schematic cross section of the device of the invention illustrating the position of the extrusion resistant biaxially woven sleeve.

Referring to FIG. 1, one of ordinary skill in the art will recognize the typical cross section of an end assembly of an external casing packer (ECP) 10. Within the ECP 10, a mandrel 12 is disposed at the inside diameter of the tool. Radially outwardly of mandrel 12 is an inflatable element such as an expandable boot or inner-tube 14, which most commonly is constructed of rubber, although other expandable materials may be employed as desired.

Located radially outwardly of boot 14 is an extrusion resistant mechanism which preferably is biaxially woven sleeve 16, which is critical to the functionality of the invention. The sleeve 16 is interposed between the boot 14 and ribs 18 which are mounted within the outer cover 20 and end sleeve 22 of the tool of the invention. Ribs 18 are constructed and overlapped according to industry standards, known to one of ordinary skill in the art. Upon expansion of boot 14, in a noncylindrical shaped borehole environment, ribs 18 expand beyond the intended amount and subject the tool to damage. The distorted ribs 18, even after deflation of the inflatable tool may hinder removal of the tool from the borehole costing both time and money. The interposition of sleeve 16, between boot 14 and ribs 18 provides an effective bridge between the ribs when they open upon inflation, which is sufficient to retain boot 14 and prevent extrusion thereof through ribs 18. Sleeve 16 is about 18" long and is located substantially over the intersection between end sleeve 22 and rubber outer cover 20 to prevent the deformation of ribs 18 as well as the extrusion of boot 14.

Figure 2:
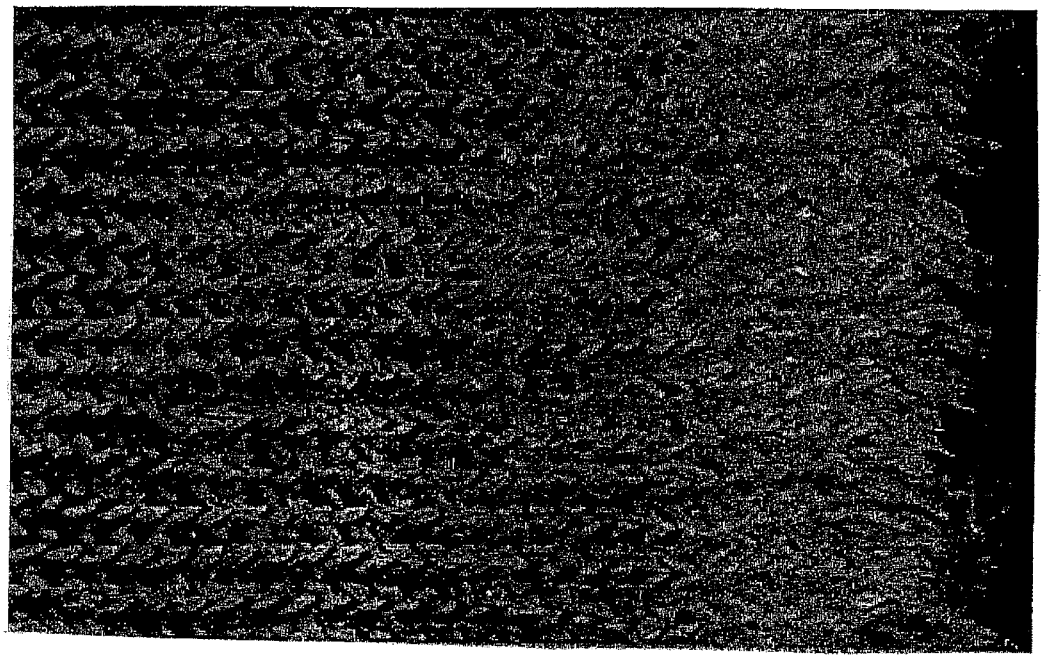
FIG. 2 is a view of the sleeve itself illustrating the pattern thereof.

Sleeve 16 may preferably be constructed of carbon fiber or aramid fiber (or kevlar), fiberglass or other similiar fiber material having comparable properties. It is noted that the stronger fibers, i.e. carbon, kevlar are preferred. The fibers are at an acuate angle relative to one another. The acuate angle illustrated in FIG. 2 is about 45 degrees.

Figure 3:
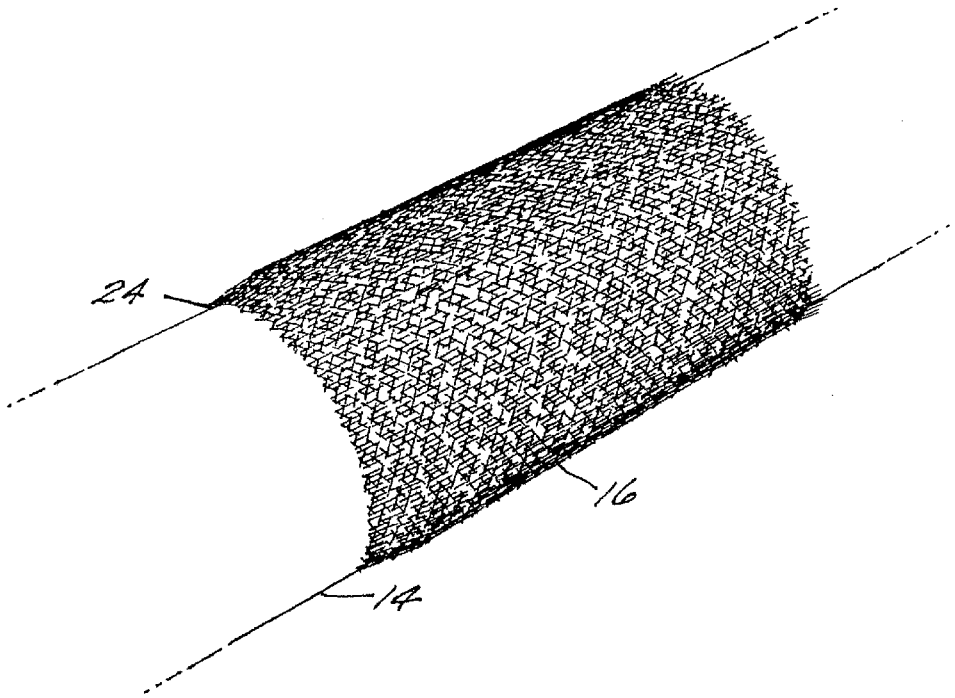
FIG. 3 is an illustration of the sleeve disposed around the rubber boot.

In construction of the device of the invention referring to FIG. 3, the uphole end 24 of sleeve 16 is tightly wrapped about boot 14 and generally does not move from its original location. In order to allow the sleeve 16 to expand however, it is preferable to provide a friction lowering material 26. Such material may be applied to the inflatable element or to the sleeve or both. Additionally the friction lowering material 26 could simply be dispersed between the two. Wrap boot 14 with Teflon tape or other similar friction reducing material under all but the uphole end 24 of sleeve 16. The sleeve 16 is commercially available from A&P Technology, Covington, Ky.

Figure 4:
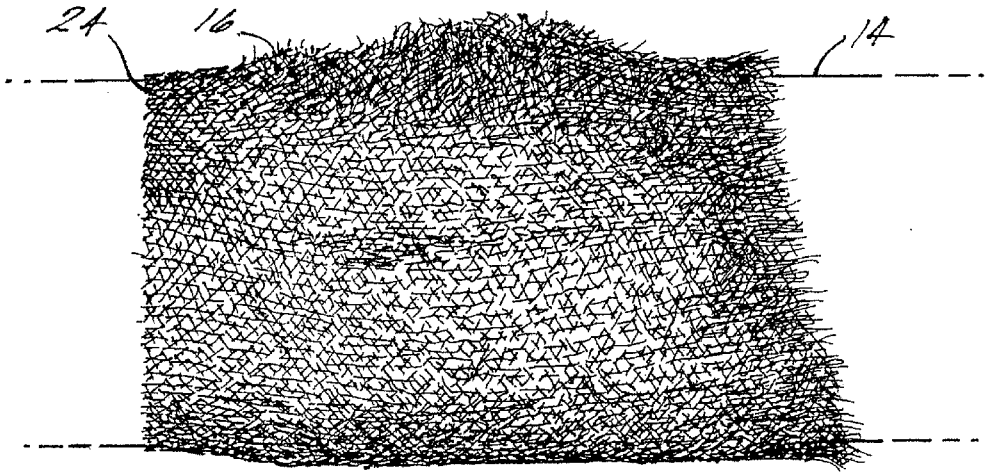
FIG. 4 is an illustration of a sleeve around the rubber boot after inflation and deflation.

FIG. 4 illustrates the condition of the sleeve after inflation of boot 14 and deflation thereof. Although damage is notable on the sleeve, it is also apparent that the boot 14 did not extrude through the ribs of the inflatable device. Thus, the construction of the device of the invention overcomes the prior art difficulty of a rubber boot being extruded through the ribs of the inflatable device during inflation in a noncylindrical borehole environment.

While preferred embodiments have been shown and described, various modifications and substitutions may be made thereto without departing from the spirit and scope of the invention. Accordingly, it is to be understood that the present invention has been described by way of illustration and not limitation.

What is claimed is:

1. An inflatable tool comprising:

a mandrel;

an inflatable element disposed about said mandrel;

an extrusion resistant at least biaxially woven sleeve wherein said sleeve is composed of strong fibers laid in at least two axial directions, said sleeve being disposed about said element said sleeve being unaffixed on at least one end thereof; and a plurality of ribs disposed about said extrusion resistant sleeve.

2. The inflatable tool of claim 1, wherein said tool further comprises a plurality of ribs disposed about said extrusion resistant sleeve.

3. The inflatable tool of claim 2, wherein said extrusion resistant sleeve is a woven material.

4. The inflatable tool of claim 3, wherein said woven material is biaxially woven.

5. The inflatable tool of claim 3, wherein said material is one of carbon fiber, Aramid fiber and fiberglass.

6. The inflatable tool of claim 1, wherein said tool further includes a friction lowering material disposed between said extrusion resistant sleeve and said inflatable element.

7. The inflatable tool of claim 6, wherein said friction lowering material is applied to said element.

8. The inflatable tool of claim 7, wherein said friction lowering material is polytetrafluoroethylene tape.

9. The inflatable tool of claim 6, wherein said friction lowering material is applied to said extrusion resistant sleeve.

10. The inflatable tool of claim 1, wherein said extrusion resistant sleeve is composed substantially of material having a low coefficient of friction.

11. An inflatable tool as claimed in claim 1 wherein said biaxially woven sleeve is constructed of fibers woven at an acuate angle to one another.

12. An inflatable tool as claimed in claim 11 wherein said acuate angle is about 45 degrees.

* * * * *